United States Patent [19]

Yamamoto et al.

[11] Patent Number: 4,851,876

[45] Date of Patent: Jul. 25, 1989

[54] PAPER DISCHARGE CONTROL METHOD IN AN IMAGE FORMING APPARATUS HAVING AN INTERMEDIATE TRAY

[75] Inventors: Haruo Yamamoto, Osaka; Masamitsu Yamane, Sakai; Shusaku Ogawa, Osaka, all of Japan

[73] Assignee: Mita Industrial Co., Ltd., Osaka, Japan

[21] Appl. No.: 161,942

[22] Filed: Feb. 29, 1988

[30] Foreign Application Priority Data

Mar. 2, 1987 [JP] Japan ..... 62-48512
Mar. 2, 1987 [JP] Japan ..... 62-48513

[51] Int. Cl.[4] ..... G03G 15/00

[52] U.S. Cl. ..... 355/323; 271/3.1; 271/291

[58] Field of Search ..... 271/3.1, 301, 288, 289, 271/290, 291; 355/3 SH, 14 SH, 28, 24, 23

[56] References Cited

U.S. PATENT DOCUMENTS 4,437,756 3/1984 Kawakubo et al. ..... 355/14 R
4,561,765 12/1985 Masuda ..... 355/14 SH
4,655,582 4/1987 Okuda et al. ..... 355/14 SH
4,745,439 5/1988 Hanada et al. ..... 271/3.1

FOREIGN PATENT DOCUMENTS 56-95262 8/1981 Japan .

*Primary Examiner*—F. J. Bartuska
*Assistant Examiner*—Kenneth Noland
*Attorney, Agent, or Firm*—Beveridge, DeGrandi & Weilacher

[57] ABSTRACT

When forming an image on both sides of set number of sheets of paper, excess paper which remains in an intermediate tray caused by an overlapped feeding of the paper is guided into a bin which has not been in use for the image forming of the above set number of sheet. Further, when some sheets of the paper discharged from the intermediate tray are transferred in an overlapped condition and the paper in the intermediate tray becomes insufficient, the image forming operation corresponding to the insufficient number of sheet of the paper is discontinued, and the sorting operation for the next original starts from a sort bin skipping over some sort bins which should have received the uncopied paper because of overlapped feeding.

8 Claims, 5 Drawing Sheets

PAPER DISCHARGE CONTROL METHOD IN AN IMAGE FORMING APPARATUS HAVING AN INTERMEDIATE TRAY

BACKGROUND OF THE INVENTION

The invention relates to a paper discharge control method of an image forming apparatus having an intermediate tray and more particularly to a paper discharge control method applied to an image forming apparatus in which after the paper which is provided with a first image forming process is guided into the intermediate tray, the paper is taken out from the intermediate tray and provided with the image forming process again, and is guided to a specified bin.

In an image forming apparatus of an electrostatic copying machine and the like, there has been a strong demand for multiple functions In recent years, there is provided an image forming apparatus which has what is called a duplex image forming function whereby an image forming is provided on both sides of a sheet of paper or what is called an editing function whereby an image forming which corresponds to two or more sheets of originals is provided on a sheet of paper.

In order to form an image on a plurality of sheets of paper using a duplex image forming function or an editing function such as above and to sort the paper into a sorter, the following methods are adopted. These methods will hereinafter be explained by referring to the case of the duplex copying. (When an editing function is adopted, it is only different mainly in that the copy paper to be guided into the intermediate tray is reversed as compared with a duplex copying function, and basically the following description can be applied.)

That is to say, it is a method in which an ordinary copying operation is caused to be provided over the obverse side of a copy paper, the copy paper whose image copying has been completed is guided in order into the intermediate tray, then sent into the copying section again, thereby causing other copying operation to be provided on the reverse side of the copy paper.

The method will further be described in detail. A plurality number of sheets of paper is set in advance by manual operation, copy paper is sent in order from a paper feeding cassette and the like to be provided with copying process corresponding to that of an original document, and those sheets of copy paper are taken once into an intermediate tray. Then, an original document is exchanged or a both-sided document is turned over, a specified key (usually a print key) is operated to take out the copy paper in order from the intermediate tray, and the copy paper is provided with the copying process again, and then guided into a specified bin in a sorter. (In the case the sort mode is selected, the copy paper is guided into a sort bin, and in the case the sort mode is not selected, the copy paper is guided into a non-sort bin.) In a manner as described above it is possible to provide a copying operation with both sides of the copy paper.

In the above electrostatic copying apparatus, if no overlapped feeding (in which more than two sheets of the copy paper are overlapped and conveyed) occurs at all while the copy paper is being guided from the paper feeding cassette into the intermediate tray in order to accomplish a first copying process, it is possible to cause a second copying process to be carried out without any inconvenience with respect to one sheet of the copy paper. If, however, an overlapping has occurred, it results in that there exists the copy paper more than the set number in the intermediate tray and that the copy paper remains in the intermediate tray at the time the second copying process is completed.

Therefore, in the case where the copy paper remains in the intermediate tray, there has been adopted conventionally either of the following methods.

(A): An all clear key is operated, and automatically or by manual operation in the same manner as a jam process, the copy paper is taken out from the intermediate tray.

(B): The copying process is carried out unconditionally for all of the copy paper which exists in the intermediate tray, thus taking out the copy paper. (See pages 28 and 29 of Japanese Patent Application No. 171347/1979.)

In addition, if no overlapped feeding has occurred at all while the copy paper is taken out from the intermediate tray in order to carry out the second copying process, it is possible to respectively perform the second copying process against the necessary number of paper without causing any inconvenience, but in case the overlapped feeding has occurred, there does not exist copy paper in the intermediate tray even if an attempt is made to carry out the copying processes as many times as the necessary number of the copy paper.

In the case it is detected that the copy paper does not exist in the intermediate tray, either of the following methods is used to be adopted.

(C): A method for causing the copying process to be stopped forcibly.

(D): A method for causing a series of the next copying cycle to be carried out.

In the above case (A), when the copy paper remaining in the intermediate tray is taken out forcibly, the data for copying, which is set in the electrostatic copying apparatus and the sorter, is caused to be reset, and before carrying out the copying operation, it becomes necessary to accomplish resetting operation of the data such as the size of the copy paper, the number of copy to be made, and the density of the copy which are necessary for the copying operation. Also, a setting operation of the data necessary for the sorter becomes necessary, which in turn impairs the operational performance.

In the above case (B), because the copying is also accomplished with respect to the copy paper remaining in the above intermediate tray, the total number of the copy paper to be taken out will be more than the set number of sheets of the copy paper. Therefore, when the sorter is used, the copy paper which remained in the intermediate tray is sorted into the sort bin to which the first copy paper which corresponds to the next original document should have been sorted and the first copy paper which is copied with the next original document is actually sorted into the second sort bin. As the result thereof, despite of carrying out the desired sorting by the sorter, incorrectly collated or irregularly sorted copied paper will be obtained, and considerable time will be required for truing up the copied paper by manual work.

In the above case (C), when the all clear key or the like is operated to reset the stopping status forcibly so as to make it possible to execute the copying process again, the electrostatic copying apparatus and the sorter are caused to be reset necessitating the setting operation of the data necessary for the electrostatic copying apparatus as well as the setting operation of the data necessary for the sorter prior to carrying out the copying operation again. This results that operational performance is considerably impared.

In the above case (D), even though the number of the copy paper (in case the overlapped feeding occurs, because the overlapped sheets of paper are guided to the sort bin together, they are counted as one sheet of the copy paper) to be guided to the sorter is less than the set number, the sorter is controlled based on the set number of the copy paper. Therefore, as in the case of the above (B), despite of carrying out the desired sorting by the sorter, the sorted sheets of copied paper obtained consequently become irregular and it takes much time for truing them up by manual work. (E): In order to overcome the defect of (C), an electrostatic copying apparatus is proposed in which the copying operation is carried out again with respect to the obverse and reverse sides of an original document in accordance with the same data for copying or parameter so as to complete the copying of the set number of the copy paper (refer to Japanese Patent Application No. 171347/1979 on pages 29 and 30).

This proposal (E) will hereinafter be described. For convenience's sake of explanation, the following assumption is made: The set number of the copy paper is designated as n, sort bins as B1, B2, . . . , Bn. It is assumed that overlapped feeding of the copy paper which is taken out form the intermediate tray has occurred and two sheets of copy paper have been sent together to any sort bin Bi (i=1 to n). One of the two sheets of copy paper has been copied with an image on the obverse and reverse sides thereof but the other sheet has been copied with an image only on the obverse side thereof. On the other hand, because the number of the copy paper to be guided into the sorter is short by one sheet, there is no copy paper distributed into the sort bin Bn. According to the above proposal (E), the copying operation is to be provided again with the obverse and reverse sides of an original document and the copied paper is to be sorted into any sorter. By this arrangement, it becomes possible to obtain always as many numbers of copy as required.

However, among the copy paper which has been distributed into the sort bin Bi, the one sheet which is copied with an image only on the obverse side thereof will be wasted without being utilized. The reason of this is that in order to replenish the deficiency, another sheet of copied paper is being produced by newly accomplishing the copying operation with respect to the surface and reverse of an original document. Therefore, if a number of overlapped feeding should occur, wasteful consumption of the copy paper would be resulted.

An object of the present invention is to provide a discharge control method of copy paper in which when taking out the copy paper which remains in the intermediate tray at the time the set number of image forming process is carried out, it is possible to eliminate the data setting operation for the succeeding image formation and to reduce the time for truing up the image-formed paper by manual work.

Another object of the present invention is to provide a discharge control method of copy paper in which when no copy paper exists in the intermediate tray before carrying out the set number of the image forming process, it is possible to reduce the time for sorting the image-formed paper which is obtained by a series of succeeding image forming processes and to prevent wasteful consumption of the copy paper.

In a discharge control method of copy paper according to the present invention for accomplishing the above objects, in the case the copy paper is remaining in the intermediate tray at the time the set number of the image forming process is completed, on condition that a specified key has been operated, the following processes are carried out: The copy paper existing in the above intermediate tray is successively taken out, image forming process is provided thereon, and then the paper thus copied is guided into a bin which has not been used for sorting when the image forming is performed with respect to the above set number of the paper.

If the copy paper still remains in the intermediate tray at the time the set number of the image forming process has been caused to be carried out, it can be judged that overlapped feeding has occurred in the copy paper guided for the first image forming process. Therefore, according to the discharge control method of copy paper described above, only in the case a specified key operation is carried out, the copy paper remaining in the intermediate tray is taken out forcibly in order and provided with the image forming process, then the paper is guided into the bin of the sorter which has not been used for discharging the set number of sheets of copy paper. In this case, it is possible to take out forcibly the remaining paper in a state where the initial data is preserved as it is and to provide the second image formation with respect to the taken out paper, without carrying out the data setting operation anew. Therefore, finally it is possible to obtain the set number of the copied paper which is provided with two or more image forming processes simply by replacing the obtained paper. The embodiments in which two image forming processes are performed are hereby described.

In the discharge control method of the copy paper according to the present invention for accomplishing the other object of the above, in the case there does not exist paper in the intermediate tray before completing the set number of the image forming process, on condition that a specific key operation has been carried out, the image forming operation the number of which is relevant to that of uncopied paper because of overlapped feeding is discontinued, and the sorting operation for the next original starts from a sort bin skipping over some sort bins which should have received the uncopied paper mentioned above.

According to the discharge control method of paper described above, in the case where the paper provided once with the image forming process is guided into the intermediate tray and then the image forming process is provided with the paper which is taken out again from the intermediate tray and guided into the sorter, if there does not exist the paper in the intermediate tray before causing the set number of the image forming process to be carried out, it can be judged that the overlapped feeding is occurring in taking out the paper for the second image forming process. Thus, only in the case where a specified key operation has been carried out, the image forming operation the number of which is relevant to that of uncopied paper because of overlapped feeding is discontinued and the paper feeding for the next image forming process is carried out. In this case, because the sort bin corresponding to the above mentioned discontinued image forming operation is skipped and the paper which corresponds to the next image formation is sorted from the next sort bin, it is possible to precisely guide the image-formed paper obtained by a series of subsequent image forming processes, into the corresponding sort bin.

Therefore, because only the image-formed paper corresponding to a series of image forming processes where overlapped feeding occurred becomes insufficient in any of the sort bin of the sorter, and it is precisely sorted into the desired sort bin with respect to the image-formed paper which corresponds a series of other image forming process, it is possible to reduce the time for truing up the image-formed paper after all the image forming processes have been completed, to the minimum required level. In addition, while truing up operation, by taking out the image-formed paper corresponding to a series of image forming process where the above overlapped feeding has occurred, and by providing the second image forming process, it becomes possible to utilize the paper without wasting it.

The above and other features of the present invention will hereinafter be made further apparent by the following explanations by referring to the attached drawings.

DETAILED DESCRIPTION OF THE EMBODIMENTS

Figure 5:
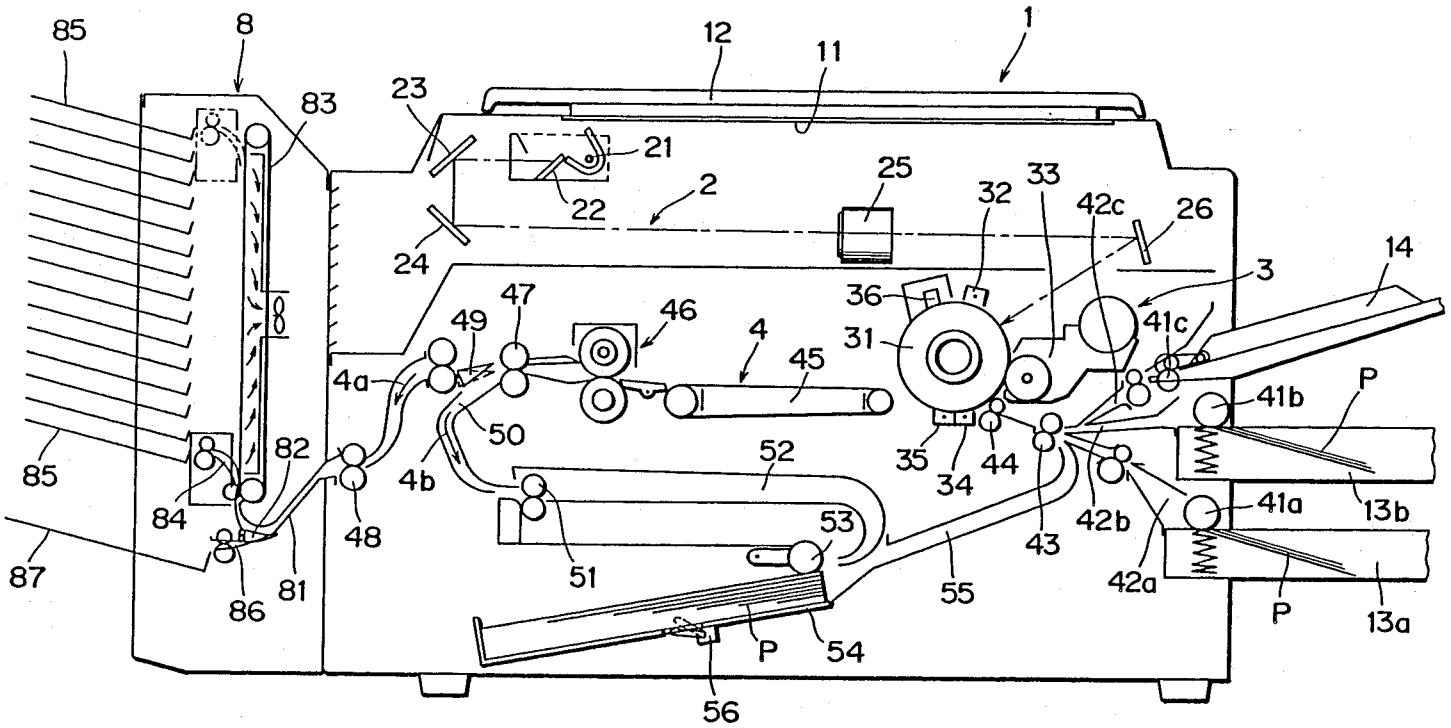
FIG. 5 is a schematic diagram showing an internal mechanism of an electrostatic copying apparatus having a duplex copying function.

FIG. 5 is a schematic diagram which explains an internal mechanism of an electrostatic copying apparatus which is equipped with an automatic duplex copying function. The electrostatic copying apparatus is provided with a transparent platen 11 and an original document cover 12 on the upper part of a body 1, and an optical section 2, a copying section 3 and a copy paper conveying section 4 inside the body 1.

The above optical section 2 comprises an exposure lamp 21, mirrors 22, 23, 24, a lens 25, and a mirror 26. An original document (not shown in the diagram) set on the above transparent platen 11 is exposed by the exposure lamp 21, so that the reflected light from the original document can be guided into the copying section 3 through the mirrors 22, 23, 24, the lens 25, and the mirror 26.

The above copying section 3 has a structure in which a charging corona discharger 32, a developer 33, a transferring corona discharger 34, a separating corona discharger 35, and a cleaner 36 are arranged in that order over the circumference of the photosensitive drum 31 which rotates in one direction. By introducing a reflected light from an original document onto the surface of the photosensitive drum 31 which caused to be charged uniformly by the charging corona discharger 32, an electrostatic latent image corresponding to an image of an original document is formed, this electrostatic latent image is formed into a toner image by the developer 33, the toner image is transferred on the surface of the copy paper P by the transferring corona discharger 34, and the toner remaining after copy paper P is caused to be peeled from the surface of the photosensitive drum by the separating corona discharger 35 is collected and removed by the cleaner 36.

The copy paper conveying section 4 comprises an ordinary copy paper conveying section **4*a* and a copy paper conveying section for feedback 4*b*. The ordinary copy paper conveying section 4*a* comprises paper feeding cassettes 13*a*, 13*b* which are extractably installed on a specified position of the body 1 of the electrostatic copying apparatus or paper feeding rollers 41*a*, 41*b*, 41*c* which feed the copy paper P one by one from a stacking bypass 14, paper feeding paths 42*a*, 42*b*, 42*c*, a registration roller 43, a conveying roller 44, a conveying belt 45, a heating and fusing device 46, a conveying roller 47, and a discharging roller 48. The copy paper conveying section 4*b* comprises a switching claw 49 which is installed between the above conveying roller 47 and the discharging roller 48, a first guide space 50 which is formed into a curve, a conveying roller 51, a second guide space 52, a secondary paper feeding roller 53, an intermediate tray 54, and a paper feeding path 55. When carrying out only one copying operation for one sheet of the copy paper P, the copy paper is conveyed only by the copy paper conveying section 4*a*, and discharged toward a sorter 8. When carrying out two copying operations for one sheet of the copy paper P, the copy paper conveying is caused to be carried out alternately by the above copy paper conveying sections 4*a*, 4*b*. In addition, in the intermediate tray 54 of above, a limit switch 56** for detecting copy paper is provided.

The sorter 8 is installed with a change-over member 82 which operates in correspondence with the sort status and non-sort status and changes the guiding direction of the copy paper and this sorter 8 is installed at a specified position of the first guiding member 81 which guides the copy paper P sent out from the above discharging roller 48. Reference numeral 83 represents a suction type belt which guides the copy paper P upward in the sort status and reference numeral 84 represents a second guiding member which is vertically movable over the entire range of the suction type belt 83. In the sort status, it is possible to discharge the copy paper P selectively into a specified sort bin 85 by means of the suction type belt 83 and the second guiding member 84. In the non-sort status, the copy paper P is caused to be discharged into the non-sort bin 87 by means of the third guiding member 86 whose installing position is fixed.

Now, the copying functions adopted for the present invention will be explained. The sort mode is a function for sorting the copy paper P automatically to each sort bin which is equal in number to the set number of the paper to be copied, when carrying out the copying of a plurality number of the copy paper with respect to an original document. To execute the sort mode, an original document is set on the transparent platen 11, a sort mode selection key is operated, the number of paper setting key is operated to set the number of the copy paper, and finally the print key is operated.

The non-sort mode is a function for discharging the copy paper P into one sort bin (usually into the non-sort bin which is provided separately from the above sort bin), when carrying our the copying of one sheet of or a plurality number of sheet with respect to an original document. To execute the non-sort mode, an original document is set on the transparent platen 11, a non-sort mode selection key is operated if necessary, and finally the print key is operated. The non-sort mode selection key is used for releasing the sort mode or the grouping mode. When the power source of the electrostatic copying apparatus is turned on, the non-sort mode is usually effected. In this case, it is not necessary to operate the non-sort mode selection key.

The grouping mode is a function for dividing the copy paper P into a desired number of sheet when carrying out the copying of a plurality number of sheets. For example, when copying the same original document to produce thirty five copies, the thirty five sheets of the copy paper P are divided into a group of twenty sheets, ten sheets, and five sheets. To execute the grouping mode, an original document is set on the transparent platen 11, a grouping mode selection key is operated, the number of sheet setting key is operated to set twenty sheets to be copied, and finally the print key is operated. Then, the twenty sheets are discharged into the first sort bin. Then, the number of sheet setting key is operated to set ten sheets to be copied (at this time, an original document may be changed), and the print key is operated. Consequently, the ten sheets are discharged into the second sort bin. And finally, the number of sheet setting key is operated to set five sheets to be copied (at this time, an original document may be changed), and the print key is operated. And, the five sheets are discharged into the third sort bin.

Continuous coping mode is a mode which is use for copying sequentially a plurality number of original documents by using an automatic original document feeding device. To execute the continuous copying mode, an original document is set on the automatic original document feeding device, and a continuous copying mode selection key is operated. An then, when the print key is operated, the first original document is copied. When the copying of the first original document is completed, the original document is automatically discharged and the second original document is automatically set. The second original document is automatically copied without the operation of the print key. Afterward, the third and fourth and so forth of the original documents are copied automatically.

Figure 4:
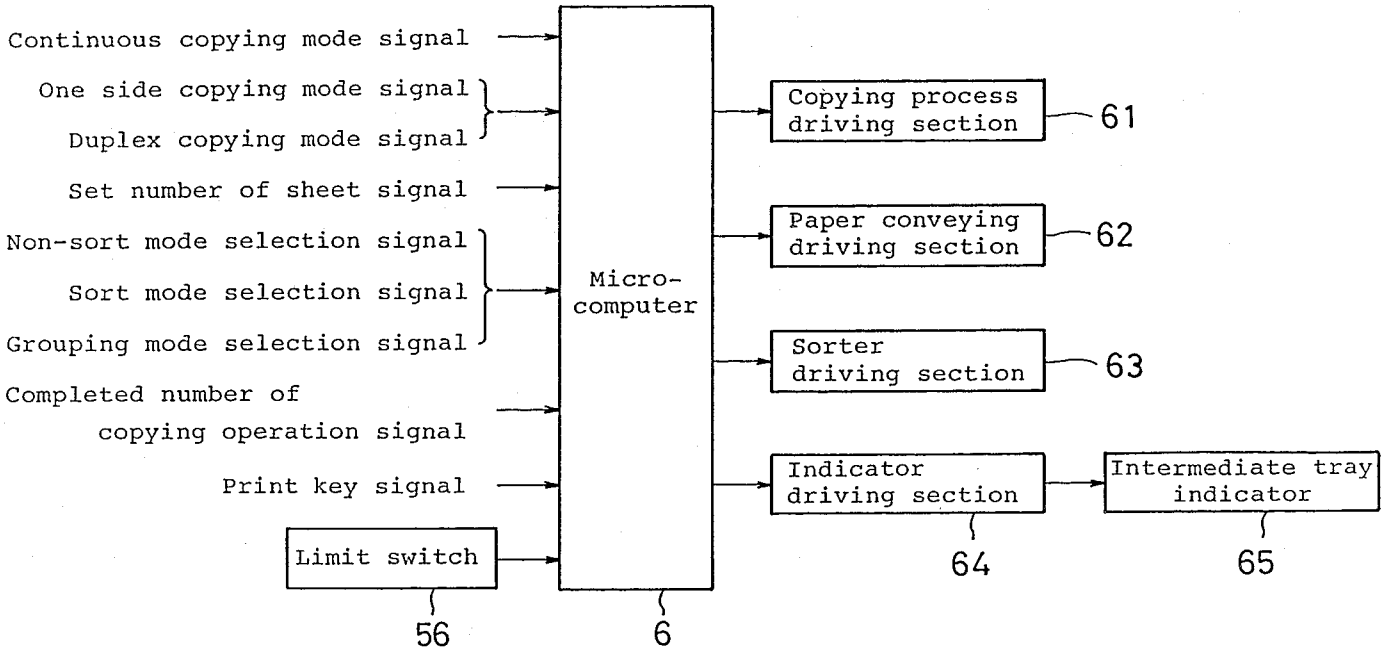
FIG. 4 is a schematic block diagram illustrating an electrical structure of an apparatus which carries out the discharge control of copy paper.

FIG. 4 is a block diagram showing a structure of an apparatus for carrying out the discharge control of the copy paper P. A microcomputer 6 is provided with a continuous copying mode signal which is generated by operating the continuous copying mode selection key, a one side/both side copying mode signal which is generated by operating a one side/both side copying mode selection key, a number of sheet setting signal which is generated by operating the number of sheet setting key, a non-sort mode, sort mode or grouping mode selection signal which is generated by operating the non-sort mode, sort mode or grouping mode selection key, a number of completed copying operation signal which is generated by the counter, a print key signal which, is generated by operating the print key, and a signal which corresponds to the status of the limit switch 56. An output signal from the microcomputer 6 is supplied to a copying process driving section 61, a copy paper conveying driving section 62, a sorter driving section 63, and an indicator driving section 64. An intermediate tray indicator 65 is connected to an indicator driving section 64.

Figure 1:
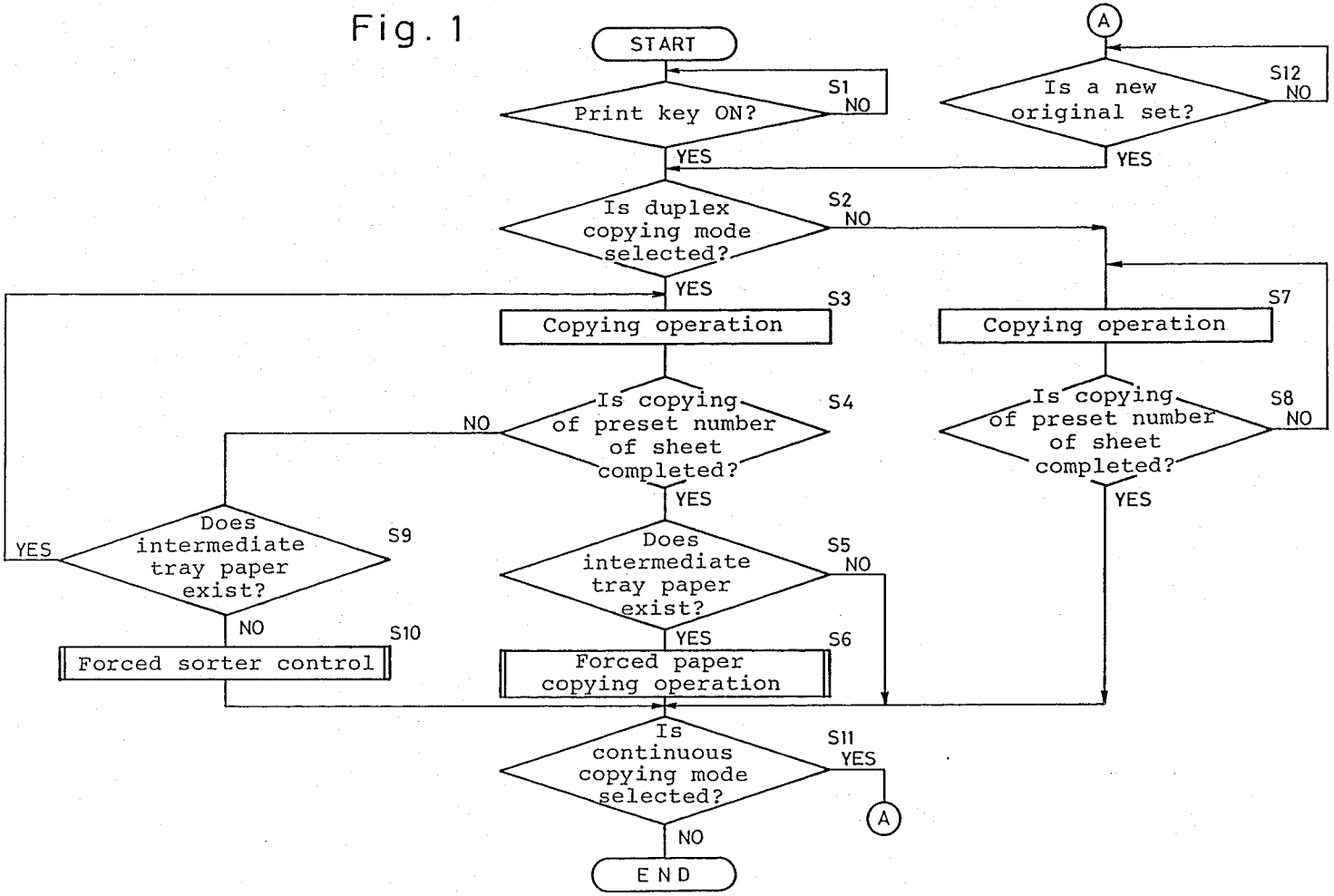
FIG. 1 is a flowchart which schematically explains the discharge control method of copy paper according to the present invention.

FIG. 1 is a flowchart which explains the operation of an electrostatic copying apparatus having the above structure. In step S1, the program waits until the print key is operated, and in step S2, it is determined whether the duplex copying mode is selected. If the duplex copying mode is selected, the copying operation is carried out in step S3, and it is determined in step 4 whether the number of the copying operation equal to the preset number of sheet is carried out. If the number of copying operation equal to the preset number of sheet is carried out, it is determined in step S5 whether the copy paper P exists in the intermediate tray 54. If the copy paper P exists in the intermediate tray 54 (if an overlapped feeding has occurred while the first copying operation is being carried out), the forced taking out and copying operation of the copy paper P are carried out in step S6. Thereafter, it is determined in step S11 whether the continuous copying mode is selected, and if it is not selected, a series of copying operations is completed.

If it is determined in the step S2 that the both side copying mode is not selected, the program moves to step S7 to carry out the copying operation, in step S8, the program waits until the number of the copying operation equal to the preset number of sheet is carried out, and the determination of step S11 is carried out.

If it is determined in step 4 that the number of the copying operation equal to the number of sheet preset is not carried out (in the case an overlapped feeding has occurred while the copy paper P is being taken out from the intermediate tray 54), it is determined in step S9 whether the copy paper P exists in the intermediate tray 54, and if it exists, the program returns to the step S3. If it does not exist, the sorter 8 is forcibly returned to the initial status in step S10 and the determination of step S11 is carried out.

If it is determined in step S5 that there does not exist the copy paper P in the intermediate tray 54, the determination of step S11 is carried out.

If it is distinguished in step S11 that the continuous copying mode is selected, the program waits until a new original document is set in step S12, and then the determination of step S2 is carried out.

If an overlapped feeding occurs while the first copying operation is being carried out in accordance with the above procedure, the copy paper P will remain in the intermediate tray 54, and therefore, the forced taking out and copying operation are caused to be carried out with respect to all sheets of the copy paper P which remain in the intermediate tray 54, and then a series of duplex copying operations will be carried out with respect to the next original document.

If an overlapped feeding occurs while the second copying operation is being carried out, the copy paper P to be taken out from the intermediate tray 54 becomes short, and therefore, the sorter 8 is caused forcibly to be restored to the initial status, and then a series of duplex copying operations will be carried out with respect to the next original document.

Figure 2:
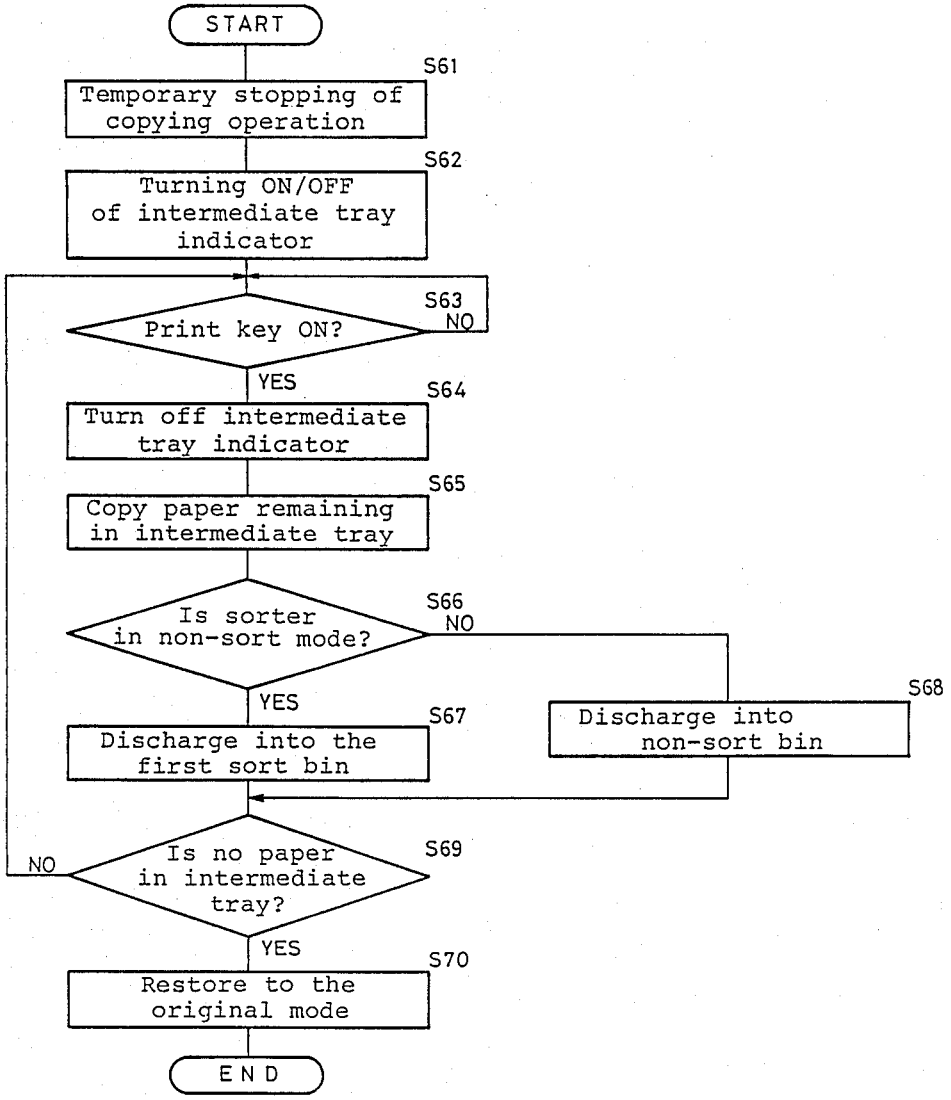
FIG. 2 is a flowchart which explains in detail the forced taking out and copying operation of copy paper.

FIG. 2 is a flowchart which explains in detail the forced taking out and copying operation of the copy paper P of the step S6. In step 61, the copying operation is caused to stop temporarily. In step S62, the intermediate tray indicator 65 is caused to turn on and off in order to indicate that the copy paper P is remaining in the intermediate tray 54. In step 63, the program waits until the print key is operated, and in step S64, the intermediate tray indicator 65 is caused to turn off, and in step S65, the copy paper P remaining in the intermediate tray 54 is taken out and the copying operation is carried out. In step S66, it is determined whether the sorter 8 is in non-sort mode. If in the non-sort mode, the copy paper P is guided into the first sort bin 85 in step S67, and it is determined in step S69 whether the copy paper P in the intermediate tray 54 does not exist. If there is no copy paper P in the intermediate tray 54, the sorter 8 is caused to be restored to the original mode in step S70, and a series of the forced discharging operations is completed.

In the above step S66, if it is determined that the non-sort mode is not selected, that is, if the sort mode or the grouping mode is selected, the copy paper P is guided into the non-sort bin 87 in step S68, and then the determination of step S69 is carried out.

In the above step S69, if it is determined that the copy paper P exists in the intermediate tray 54, the determination of step S63 and so on is carried out.

In a manner as described above, the second copying operation is performed on the copy paper P which remained in the intermediate tray 54 so that it becomes possible to guide the copy paper P into the sort bin of the sorter 8 which has not been used until then. After all the copying operation has been completed, it is possible to easily replace the copied paper where incorrect copying has occurred because of an overlapped feeding with the copied paper accommodated in the above sort bin which has not been used. In a manner as described above, it is possible to obtain a prescribed number of sheets of perfect copied paper. However, if the above intermediate tray indicator 65 is not turning on and off, and if the copy paper is not accommodated in the above sort bin which has not been used, in can be determined that an overlapped feeding has not occurred, and therefore, the time and labor such as the above can be saved.

Figure 3:
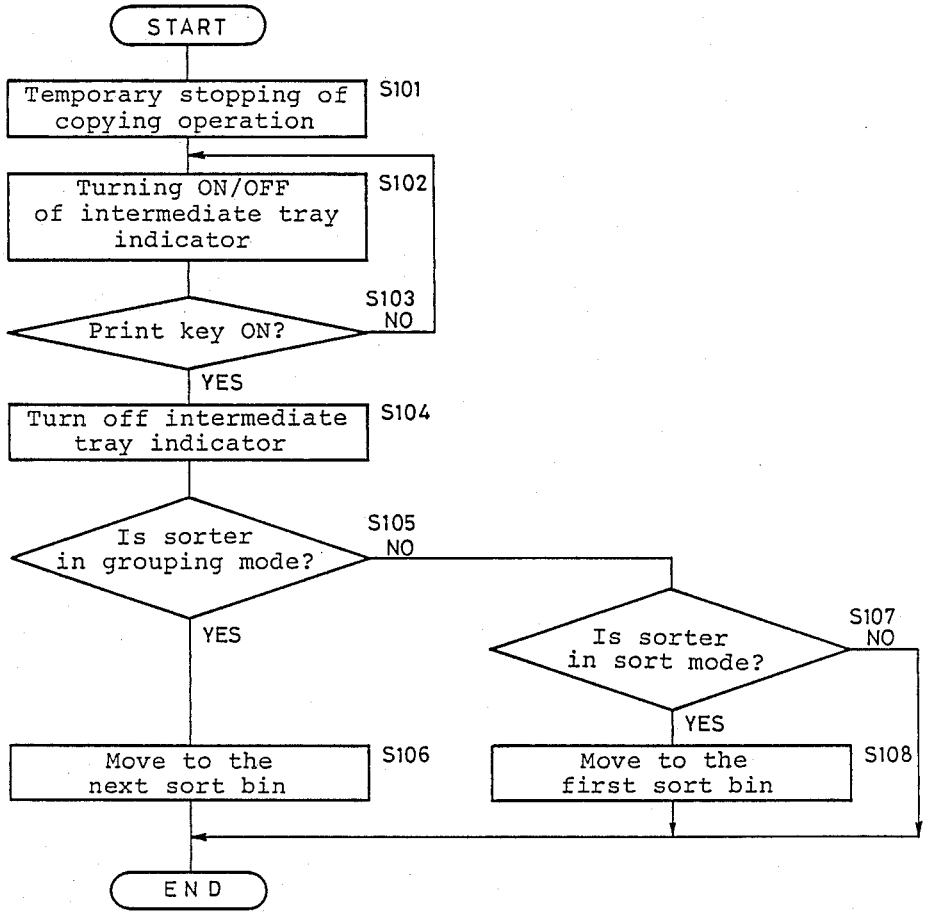
FIG. 3 is a flowchart which explains in detail the forced control operation of a sorter.

FIG. 3 is a flowchart which explains in detail the forced control of the sorter 8 in step S10. In step S101, the copying operation is temporarily stopped and in step S102, the intermediate tray indicator 65 is caused to turn on and off in order to indicate that the copy paper P is insufficient in the intermediate tray 54. In this case, in order to distinguish from the turning on and off in step S62 in FIG. 2, the intermediate tray 65 may turn on and off in a different manner. Further, an embodiment in which another indicator is provided separately from the intermediate tray indicator 65 is also possible. In step S103, the program waits until the print key is operated, the intermediate tray indicator 65 is turned off in step S104, and it is determined in step S105 whether the sorter 8 is in the grouping mode.

If determined as being in the grouping mode, the receiving sort bin of the sorter 8 is caused to move to the position of the next sort bin 85 in step S106, and the forced control of the sorter 8 is completed. If it is determined in the above step S105 that the grouping mode is not selected, it is determined in step S107 whether the sorter 8 is in the sort mode. If the sorter 8 is in the sort mode, in step S108, the receiving sort bin of the sorter 8 is caused to move to the position of the first sort bin 85, and the forced control of the sorter 8 is completed. Conversely, if it is determined in step S107 that the sort mode is not selected, the program completes the forced control of the sorter 8 as it is.

In a manner as described above, when an overlapped feeding occurs while taking out the copy paper P from the intermediate tray 54, even if a series of the next duplex copying is carried out, a series of the duplex copying operations can be entered with respect to the succeeding original documents after providing a status wherein the order of the duplex copy paper discharged so far into the sort bin 85 is not influenced, that is, a status where there is no need for truing up the copy paper.

After all the copying operations are completed, the copied paper is inspected and the incorrect copies (the copied paper which is copied with an image only on the obverse side thereof) are taken out from a sort bin where two sheets are stored, and by simply carrying out later the copying operation with respect to the above incorrect copies the required number of perfect copied sheets can be obtained. However, if the intermediate tray indicator 65 is not turning on and off, it can be understood that an overlapped feeding has not occurred, therefore the time and labor as described above can be saved.

The present invention has been described in detail referring to the above embodiments, it is, however, apparent to those skilled in the art that the present invention is not limited to the above embodiments but can be applied to an electrostatic copying apparatus which has an editing function, instead of an electrostatic copying apparatus which has a duplex copying function for example. In addition to the electrostatic copying apparatuses, it is possible to apply the present invention to an image forming apparatus such as a printer. Further, it is possible that various changes and modifications in design may be made therein without departing from the spirit and scope of the present invention.

As have been described above, when the paper remains in the intermediate tray at the time the image forming operation of a prescribed number of sheet is carried out, the present invention is capable of taking out the paper from the intermediate tray without resetting the set data, and providing the image forming operation, and further, discharging the paper into a bin which is not in use, therefore, the replacement of the image-formed paper which is obtained finally can be easily accomplished.

Also, because the receiving sort bin of the sorter is forcibly reset into the initial status to correspond with a series of image forming processes when there is no paper in the intermediate tray before carrying out the image forming operation of a prescribed number of sheet, it is possible to prevent the condition in which an overlapped feeding occurs while taking out the paper from the intermediate tray and the number of image formation is reduced, from influencing upon the sorting of the image-formed paper which is obtained from a series of other image forming processes, and consequently it is possible to reduce considerably the time and trouble for truing up the sheets of imageformed paper obtained finally.

What is claimed is:

1. A paper discharge control method employed in an image forming apparatus having an intermediate tray, wherein paper which is once provided with an image forming process is guided into the intermediate tray, the paper which is taken out again from the intermediate tray is provided with an image forming process thereafter guided into a sorter, characterized in that if the paper still remains in the intermediate tray due to the overlapped feeding when a set number of image forming process is caused to be carried out and the same set number of sheets are discharged into the sorter, the paper which remains in the intermediate tray is taken out in order, on condition that a specific key operation has been carried out, the image forming process is provided on this paper, and the paper which is provided with the image forming process is guided into a bin which is not used for discharging said set number of sheets.

2. A paper discharge control method in an image forming apparatus having an intermediate tray according to claim 1, wherein if a nonsort mode is used, the paper which is taken out from the intermediate tray and provided with the image forming process is guided into a sort bin.

3. A paper discharge control method in an image forming apparatus having an intermediate tray according to claim 1, wherein if a sort mode is used, the paper which is taken out from the intermediate tray and provided with the image forming process is guided into a non-sort bin.

4. A paper discharge control method in an image forming apparatus having an intermediate tray according to claim 1, wherein if the paper is remaining in the intermediate tray, a specific indication is caused to be carried out to indicate that the paper is remaining in the intermediate tray.

5. A paper discharge control method employed in an image forming apparatus having an intermediate tray, wherein a paper which is once provided with an image forming process is guided into the intermediate tray, the paper which is taken out again from the intermediate tray is provided with an image forming process thereafter guided into a sorter, characterized in that if the paper does not exist in the intermediate tray before completing a set number of image forming process, the image forming operation, the number of which is relevant to that of uncopied paper because of overlapped feeding, is discontinued, on condition that a specific key operation has been carried out, and the sorting operation for the next original starts from a sort bin skipping over one or more sort bins to which said uncopied paper should have been sorted.

6. A paper discharge control method in an image forming apparatus having an intermediate tray according to claim 5, wherein if a grouping mode is used, the paper which is taken out from the intermediate tray and provided with the next image forming process is guided into the next sort bin.

7. A paper discharge control method in an image forming apparatus having an intermediate tray according to claim 5, wherein if a sort mode is used, the paper which is taken out from the intermediate tray and provided with the next image forming process is guided into the first sort bin.

8. A paper discharge control method in an image forming apparatus having an intermediate tray according to claim 5, wherein if the paper does not exist in the intermediate tray, a specific indication is caused to be carried out to indicate that the paper is not existing in the intermediate tray.

* * * * *